US005937363A

United States Patent [19]

Saidi et al.

[11] Patent Number: 5,937,363

[45] Date of Patent: Aug. 10, 1999

[54] METHOD FOR CALCULATING THE DISTRIBUTION OF FLUIDS IN A RESERVOIR

[75] Inventors: Ali M. Saidi, Boulogne Billancourt; Daniel Longeron, Sartrouville, both of France

[73] Assignee: Institut Français Du Petrole, France

[21] Appl. No.: 08/880,805

[22] Filed: Jun. 23, 1997

[30] Foreign Application Priority Data

Jun. 24, 1996 [FR] France ..... 96 07914

[51] Int. Cl.[6] ..... G06F 19/00

[52] U.S. Cl. ..... 702/13

[58] Field of Search ..... 702/12, 13; 73/152.08, 73/152.09, 152.41; 166/252.2, 252.6, 272.2, 272.3

[56] References Cited

U.S. PATENT DOCUMENTS 3,757,575 9/1973 Murphy et al. ..... 73/152
4,090,398 5/1978 Deans et al. ..... 73/19
4,102,396 7/1978 Ransom et al. ..... 166/252
4,233,839 11/1980 Coates ..... 73/152.08
4,506,548 3/1985 Zemanek, Jr. ..... 73/152.08
4,508,169 4/1985 Mut et al. ..... 73/152.41
4,752,882 6/1988 Givens ..... 364/422
4,782,899 11/1988 Richardson ..... 166/252

*Primary Examiner*—Donald E. McElheny, Jr.
*Attorney, Agent, or Firm*—Millen, White, Zelano & Branigan, P.C.

[57] ABSTRACT

The invention relates to a method for characterizing a hydrocarbon reservoir comprising a gas cap (1) and an oil zone (2) with respectively Scwg and Scwo as the water saturation in each zone. The zone is invaded by gas either by gas injection, gas cap expansion or because of evolution of dissolved gases. In the method, the decrease in the initial water saturation Scwo in oil zone (6) during the displacement thereof by the gas is taken into account, the decrease being gradual down to Scwg which is distinctly below Scwo.

7 Claims, 1 Drawing Sheet

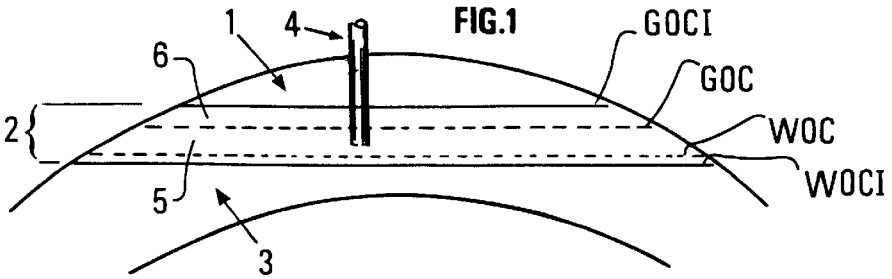
FIG.1
1
4
6
2
5
3
GOCI
GOC
WOC
WOCI
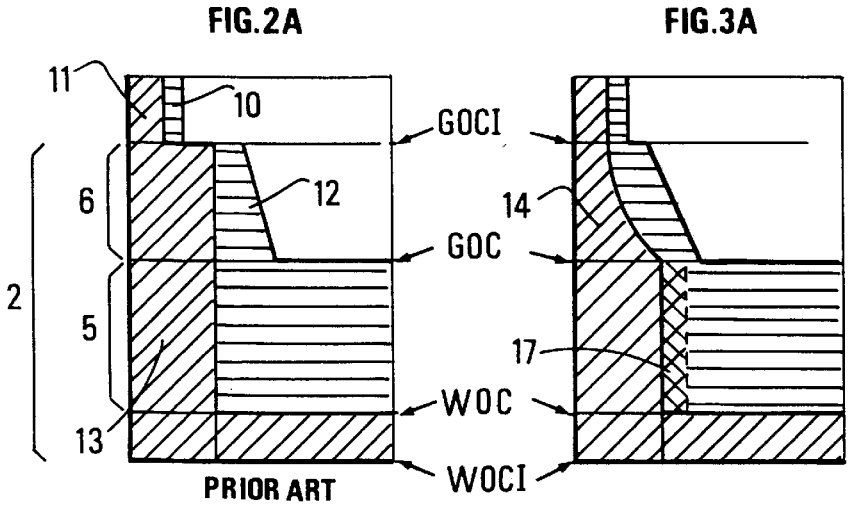
FIG.2A
FIG.3A
11
10
12
6
2
5
13
14
17
GOCI
GOC
WOC
WOCI
PRIOR ART
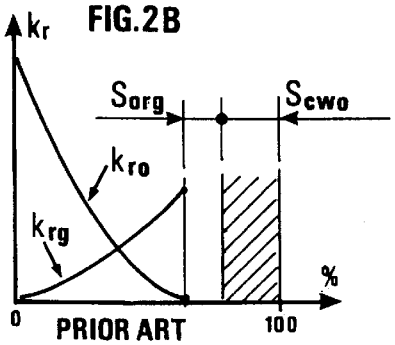
FIG.2B
kr
Sorg
Scwo
kro
krg
%
0
100
PRIOR ART
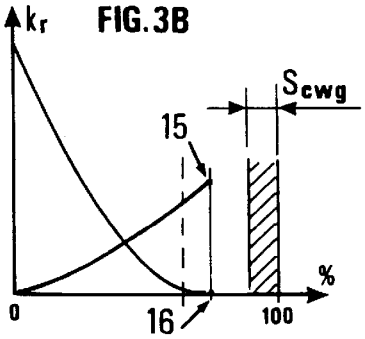
FIG.3B
kr
Scwg
15
%
0
16
100

METHOD FOR CALCULATING THE DISTRIBUTION OF FLUIDS IN A RESERVOIR

FIELD OF THE INVENTION

The present invention relates to a method for evaluating the distribution of fluids in a geologic bed forming a hydrocarbon reservoir. The present method notably applies to models simulating the production of petroleum reservoirs containing oil and gas.

BACKGROUND OF THE INVENTION

It is well-known that water, oil and gas can be found in a reservoir rock. It is important to know how these three fluids are distributed in the various points of the reservoir in order to determine the quantities of hydrocarbons in place and for production forecasts. The water present in hydrocarbon zones is referred to as interstitial or irreducible water.

The quantity of oil in place is estimated from the following relation:

Oil in place=Rock volume*porosity*(1-Scwo)/FVF where Scwo is the interstitial water saturation and FVF the formation volume factor which is equal to the volume ratio between bottomhole conditions and standard conditions.

Knowledge of the interstitial water saturation can be obtained through the following various measurements:

analysis of the wireline logs obtained by the induction or resistivity sondes lowered into a well crossing the reservoir rock, analysis of the petrophysical measurements performed most often on one or more reservoir rock samples. The water saturation is calculated at the laboratory from capillary pressure curves.

Water saturations calculated from logs and correlated with petrophysical measurements on a rock sample are thereafter used in calculations, particularly in reservoir models. The interstitial water saturation values thus calculated have been kept constant until now during reservoir simulation model studies.

SUMMARY OF THE INVENTION

The present invention thus relates to a method for characterizing a hydrocarbon reservoir comprising a gas invaded zone and an initial oil zone with respectively Swg and Scwo as the water saturation in each zone. In the method, the decrease in the water saturation in the oil zone during the displacement thereof by the gas is taken into account.

The water saturation in the gas invaded zone can be evaluated by measuring means lowered into a well crossing the said zone. These measuring means can be all the well-known means used for wireline logging, for example electrical resistivity means. Water saturation can also be evaluated from laboratory measurements performed on samples taken from the reservoir.

The invention also relates to an application of correcting the initial water saturation while characterizing and modeling a reservoir.

BRIEF DESCRIPTION OF THE DRAWINGS

Other features and advantages of the present invention will be clear from reading the description hereafter given by way of non limitative examples, with reference to the accompanying drawings wherein:

FIG. 1 diagrammatically shows an example of a reservoir in sectional view,

FIGS. 2A and 2B illustrate, according to the prior art, respectively the schematic representation of the fluids in place in the reservoir and the relative permeability curves as a function of the saturation in the oil zone and the gas invaded zone, FIGS. 3A and 3B illustrate, according to the present invention, by comparison with FIGS. 2*a* and 2*b,* the schematic representation of the actual fluids in place in the reservoir and their actual relative permeability curves as a function of the saturation in the oil zone and the gas invaded zone.

DESCRIPTION OF THE INVENTION

In FIG. 1, a reservoir represented initially by a sectional view comprises three zones 1, 2 and 3 corresponding respectively to a gas zone (gas cap), an oil zone and an aquifer. The separation planes bear reference GOC for the gas/oil contact and WOC for the water/oil contact. Index I is added to show the initial position of the two contact planes prior to production, i.e. GOCI and WOCI.

After production of the oil contained in zone 2 by means of well 4, the initial gas/oil contact GOCI descends to GOC after displacement in zone 6 of the oil by the gas. At the same time, the initial water plane WOCI can ascend to WOC, the oil zone bearing then reference number 5.

FIG. 2A diagrammatically shows an example of the distribution of the various fluids in the reservoir. This material balance is performed from the knowledge of the oil and water saturations in the gas and oil zones. Reference number 10 shows the oil saturation in the initial gas cap, reference number 11 shows the water saturation in the same zone corresponding to the interstitial water saturation in gas cap Scwg. In the zone 6 corresponding to the volume of rock impregnated with oil displaced by the gas during production, the volume of water 13 in place is evaluated, according to the prior art, from the initial water saturation in the oil zone Scwo. Reference number 12 refers to the oil that has not been yet fully displaced by the gas to Sorg.

FIG. 2B gives an example of the relative permeability curves kr, laid off as ordinate, which depend directly on the gas or oil saturation laid off as abscissa.

It appears that the saturation Scwg measured by capillary pressure in an air/water system is considerably lower than that of Scwo measured by capillary pressure in an oil/water system on the same samples. This observation can be confirmed by means of mesured water saturations by logging technique in the gas cap and in the oil zone, particularly in case of water wet reservoirs.

It can be inferred from these observations, particularly in the case of water-wet reservoirs, that the initial water saturation in zones invaded by gas decreases regularly during production until it tends to the value Scwg. As the oil/gas contact goes down in the reservoir and the height of the column of oil decreases, much more water is produced during the draining process. The excess water is drained towards the remaining oil column and possibly reaches the water zone (shown as 17 in FIG. 3A).

As a result, modelings giving the saturation distribution profile in the reservoir are wrong, insofar as the initial water saturation in the gas invaded zone is kept constant, i.e. using Scwo instead Scwg.

Comparison of the representations of FIGS. 2A and 2B with FIGS. 3A and 3B resulting from the present invention very clearly illustrates the situation difference as the considerable decrease in the water saturation in the oil zone displaced by the gas is taken into account. Zone 14 which represents the quantity of residual water is obviously smaller than that evaluated according to the prior art. It also appears that the singular points 15 and 16 of the relative permeability curves of FIG. 3B have moved in relation to the similar points of FIG. 2B according to the prior art. The reservoir simulations obtained from the present invention are therefore very substantially different from those obtained according to the prior art.

On the other hand, the highly notable difference between Scwo and Scwg results in that:

the distribution of the oil, water and gas saturations in the gas invaded zone and in the oil zone are modified, the calculated volume of water in place in the water invaded zone, based on the measurement of the level of the water/oil contact and of the required water entry volume, is under-estimated since water is drained from the gas invaded zone.

Therefore, either the oil displacement efficiency by the water is under-estimated, or the real oil/water contact is higher than the calculations.

Under such conditions:

1) The efficiency of oil displacement by gas injection, in the gas invaded zone becomes smaller than that determined by simulation models.
2) The efficiency of oil displacement by the water in the water-swept zone therefore becomes higher than that calculated by simulation models. In fact, the water displaced in the gas invaded zone either adds directly to the injected water, or to the water resulting from the natural rise of the water level, or it may be produced with oil from the oil column, known as premature water breakthrough.
3) The material balance in a reservoir portion is substantially different in actual fact in relation to the calculations performed by simulation models according to the prior art.

The present invention thus allows to simulate what in fact takes place in the reservoir.

The two relative permeability curves for each rock type have to be introduced in the model, one giving Scwo in the oil zone, and the other Scwg in the gas invaded zone, which varies with time.

Example of the LAKEVIEW, Calif., reservoir:

The LAKEVIEW reservoir is a small stratigraphic trap discovered in 1910, containing about 11 million $m^3$ of oil under storage conditions and whose oil zone height is about 1300 ft (400 m). The formation consists of a thickness of about 200 ft (60 m) of clean sandstone with a permeability of about 2 Darcy and an interstitial water saturation Scw of about 23.5%. The reservoir has the shape of a plate inclined at about 24° and closed on its six sides.

After an initial oil production of about 2 million $m^3$ under storage conditions, from only one well, the field was closed for more than 20 years. Towards 1935, the reservoir was started again and more completely developped from 300 wells.

The oil/gas contact was regularly measured as it moved towards the bottom of the reservoir. All the wells were producing by means of borehole pumps.

The wells produced water at about 500 to 600 ft (150 to 180 m) from the middle and bottom of reservoir. This water production was attributed to the coning phenomenon and to invasion by a water external to the reservoir, which was not possible considering the entirely closed nature of the present reservoir. The seal assembly of the casing cementings is then usually suspected. The cumulative water production in this reservoir is about 3 million $m^3$ under surface conditions, which corresponds to nearly 50% of the volume of water initially in place, considering the intial saturation Scwo. This thus corresponds to the results described in the present invention. Erroneous interpretation of the provenance of the water have led the operators to a wrong evaluation of the source of the water production.

We claim:

1. In a method for characterizing oil reservoirs, comprising an oil zone, and a developed gas invaded zone, the improvement comprising measuring a decrease of water saturation in the gas invaded zone during the displacement of oil in the oil zone, (Scwo) down to a residual value of water saturation in the gas invaded zone (Scwg).

2. A method as claimed in claim 1, wherein the decrease of the water saturation in the gas invaded zone is evaluated by measuring means in said zone.

3. A method as claimed in claim 1, wherein the decrease of the water saturation in the gas invaded zone is evaluated by measurements performed on the rock samples taken from said zone.

4. A method as claimed in claim 1, further comprising developing reservoir simulation models for correction and upgradation.

5. A method as claimed in claim 2, further comprising developing reservoir simulation models for correction and upgradation.

6. A method as claimed in claim 3, further comprising developing reservoir simulation models for correction and upgradation.

7. A method according to claim 1, wherein said oil reservoir further comprises a gas cap.

* * * * *